US009173258B2

(12) United States Patent
Ekbote

(10) Patent No.: US 9,173,258 B2
(45) Date of Patent: Oct. 27, 2015

(54) LIGHTING APPARATUS INCLUDING A CURRENT BLEEDER MODULE FOR SINKING CURRENT DURING DIMMING OF THE LIGHTING APPARATUS AND METHODS OF OPERATING THE SAME

(71) Applicant: Cree, Inc., Durham, NC (US)

(72) Inventor: Ashish Ekbote, Carpinteria, CA (US)

(73) Assignee: Cree, Inc., Durham, NC (US)

( * ) Notice: Subject to any disclaimer, the term of this patent is extended or adjusted under 35 U.S.C. 154(b) by 310 days.

(21) Appl. No.: 13/828,703

(22) Filed: Mar. 14, 2013

(65) Prior Publication Data

US 2014/0265888 A1 Sep. 18, 2014

(51) Int. Cl.

| | |
|---|---|
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.

CPC ..... *H05B 33/0809* (2013.01)

(58) Field of Classification Search

USPC ..... 315/186, 119

See application file for complete search history.

(56) References Cited

U.S. PATENT DOCUMENTS

| | | | | |
|---|---|---|---|---|
| 7,872,427 | B2 * | 1/2011 | Scianna | 315/291 |
| 8,575,901 | B2 * | 11/2013 | Chang et al. | 323/241 |
| 8,581,504 | B2 * | 11/2013 | Kost et al. | 315/209 R |
| 8,847,517 | B2 * | 9/2014 | Sutardja et al. | 315/307 |
| 8,937,435 | B1 * | 1/2015 | Sutardja et al. | 315/219 |
| 8,963,449 | B2 * | 2/2015 | Melanson | 315/307 |
| 2011/0163683 | A1 * | 7/2011 | Steele et al. | 315/192 |
| 2012/0056553 | A1 * | 3/2012 | Koolen et al. | 315/291 |
| 2013/0181619 | A1 * | 7/2013 | Tischler et al. | 315/185 R |
| 2014/0191655 | A1 * | 7/2014 | Kasakura et al. | 315/32 |
| 2014/0232288 | A1 * | 8/2014 | Brandes et al. | 315/250 |
| 2014/0232289 | A1 * | 8/2014 | Brandes et al. | 315/250 |
| 2014/0265888 | A1 * | 9/2014 | Ekbote | 315/186 |
| 2014/0339984 | A1 * | 11/2014 | Leung et al. | 315/122 |
| 2015/0048757 | A1 * | 2/2015 | Boonen et al. | 315/294 |
| 2015/0048761 | A1 * | 2/2015 | Lau et al. | 315/307 |
| 2015/0054422 | A1 * | 2/2015 | Koo | 315/250 |
| 2015/0069929 | A1 * | 3/2015 | Sumitani et al. | 315/291 |

* cited by examiner

*Primary Examiner* — Adam Houston

(74) *Attorney, Agent, or Firm* — Myers Bigel Sibley & Sajovec, PA

(57) ABSTRACT

A lighting apparatus includes an input power terminal, a light source element coupled to the input power terminal, and a current bleeder module that is connected to the input power terminal and is configured to draw a current from the input power terminal responsive to a phase cut input power signal received at the input power terminal during a first portion of a period of the phase cut input power signal and is configured as an open circuit so as not to draw current from the input power terminal during a second portion of the period of the phase cut input power signal.

28 Claims, 7 Drawing Sheets

LIGHTING APPARATUS INCLUDING A CURRENT BLEEDER MODULE FOR SINKING CURRENT DURING DIMMING OF THE LIGHTING APPARATUS AND METHODS OF OPERATING THE SAME

FIELD

The present inventive subject matter relates to lighting apparatus and methods and, more particularly, to solid-state lighting apparatus and methods.

BACKGROUND

Solid-state lighting arrays are used for a number of lighting applications. For example, solid-state lighting panels including arrays of solid-state light emitting devices have been used as direct illumination sources, for example, in architectural and/or accent lighting. A solid-state light emitting device may include, for example, a packaged light emitting device including one or more light emitting diodes (LEDs), which may include inorganic LEDs, which may include semiconductor layers forming p-n junctions and/or organic LEDs (OLEDs), which may include organic light emission layers.

Solid-state lighting arrays are used for a number of lighting applications. For example, solid-state lighting panels including arrays of solid-state light emitting devices have been used as direct illumination sources, for example, in architectural and/or accent lighting. Solid-state lighting devices are also used in lighting fixtures, such as incandescent bulb replacement applications, task lighting, recessed light fixtures and the like. For example, Cree, Inc. produces a variety of recessed downlights, such as the LR-6 and CR-6, which use LEDs for illumination. Solid-state lighting panels are also commonly used as backlights for small liquid crystal display (LCD) screens, such as LCD display screens used in portable electronic devices, and for larger displays, such as LCD television displays.

A solid-state light emitting device may include, for example, a packaged light emitting device including one or more LEDs. Inorganic LEDs typically include semiconductor layers forming p-n junctions. Organic LEDs (OLEDs), which include organic light emission layers, are another type of solid-state light emitting device. Typically, a solid-state light emitting device generates light through the recombination of electronic carriers, i.e. electrons and holes, in a light emitting layer or region.

Many control circuits for lighting utilize phase cut dimming. In phase cut dimming, the leading or trailing edge of the line voltage is manipulated to reduce the RMS voltage provided to the light. When used with incandescent lamps, this, reduction in RMS voltage results in a corresponding reduction in current and, therefore, a reduction in power consumption and light output. As the RMS voltage decreases, the light output from the incandescent lamp decreases.

An example of a cycle of a full wave rectified AC signal is provided in FIG. 1A, a cycle of a phase cut ("leading edge") rectified AC waveform is illustrated in FIG. 1B and a cycle of a reverse phase cut ("trailing edge") AC waveform is illustrated in FIG. 1C. As seen in FIGS. 1A through 1C, when phase cut dimming is utilized, the duty cycle of the resulting rectified waveform is changed. This change in duty cycle, if sufficiently large, is noticeable as a decrease in light output from an incandescent lamp. The "off" time does not result in flickering of the incandescent lamp because the filament of an incandescent lamp has some thermal inertia and will remain at a sufficient temperature to emit light even during the "off" time when no current flows through the filament.

Recently, solid state lighting systems have been developed that provide light for general illumination. These solid state lighting systems utilize light emitting diodes or other solid state light sources that are coupled to a power supply that receives the AC line voltage and converts that voltage to a voltage and/or current suitable for driving the solid state light emitters. Typical power supplies for light emitting diode light sources include linear current regulated supplies and/or pulse width modulated current and/or voltage regulated supplies.

Many different techniques have been described for driving solid state light sources in many different applications, including, for example, those described in U.S. Pat. No. 3,755,697 to Miller, U.S. Pat. No. 5,345,167 to Hasegawa et al, U.S. Pat. No. 5,736,881 to Ortiz, U.S. Pat. No. 6,150,771 to Perry, U.S. Pat. No. 6,329,760 to Bebenroth, U.S. Pat. No. 6,873,203 to Latham, II et al, U.S. Pat. No. 5,151,679 to Dimmick, U.S. Pat. No. 4,717,868 to Peterson, U.S. Pat. No. 5,175,528 to Choi et al, U.S. Pat. No. 3,787,752 to Delay, U.S. Pat. No. 5,844,377 to Anderson et al, U.S. Pat. No. 6,285,139 to Ghanem, U.S. Pat. No. 6,161,910 to Reisenauer et al, U.S. Pat. No. 4,090,189 to Fisler, U.S. Pat. No. 6,636,003 to Rahm et al, U.S. Pat. No. 7,071,762 to Xu et al, U.S. Pat. No. 6,400,101 to Biebl et al, U.S. Pat. No. 6,586,890 to Min et al, U.S. Pat. No. 6,222,172 to Fossum et al, U.S. Pat. No. 5,912,568 to Kiley, U.S. Pat. No. 6,836,081 to Swanson et al, U.S. Pat. No. 6,987,787 to Mick, U.S. Pat. No. 7,119,498 to Baldwin et al, U.S. Pat. No. 6,747,420 to Barth et al, U.S. Pat. No. 6,808,287 to Lebens et al, U.S. Pat. No. 6,841,947 to Berg Johansen, U.S. Pat. No. 7,202,608 to Robinson et al, U.S. Pat. No. 6,995,518, U.S. Pat. No. 6,724,376, U.S. Pat. No. 7,180,487 to Kamikawa et al, U.S. Pat. No. 6,614,358 to Hutchison et al, U.S. Pat. No. 6,362,578 to Swanson et al, U.S. Pat. No. 5,661,645 to Hochstein, U.S. Pat. No. 6,528,954 to Lys et al, U.S. Pat. No. 6,340,868 to Lys et al, U.S. Pat. No. 7,038,399 to Lys et al, U.S. Pat. No. 6,577,072 to Saito et al, and U.S. Pat. No. 6,388,393 to Illingworth the disclosures of which are hereby incorporated herein by reference.

In the general illumination application of solid state light sources, one desirable characteristic is to be compatible with existing dimming techniques. In particular, dimming that is based on varying the duty cycle of the line voltage may present several challenges in power supply design for solid state lighting. Unlike incandescent lamps, LEDs typically have very rapid response times to changes in current. This rapid response of LEDs may, in combination with conventional dimming circuits, present difficulties in driving LEDs.

The switch or circuit element that controls the power on-off inside a typical phase control dimmer is typically a type of thyristor device commonly known in the art as a TRIAC. TRIACs generally have a first main terminal MT1 a second main terminal MT2 and a gate terminal G and allow bidirectional conduction through the main terminals, allowing AC to pass through. The TRIAC is turned on and conduction is present between the main terminals when there is a trigger current present between gate G and second main terminal MT2. Once triggered, the TRIAC remains on until a zero crossing of the AC power line at which point the device turns off and awaits the next trigger pulse or zero crossing of the AC power line. This characteristic allows phase angle control to be achieved.

A TRIAC will not remain in the on state after triggering without a current larger than the hold current passing through the main terminals. Because of the need to hold a current, TRIACs may have difficulty remaining on when a low current is drawn through the main terminals, such as in the case of LED lighting. Some TRIACs may have a hold current of around 20 milliamps.

LED lighting is generally more energy efficient that incandescent light. A typical incandescent light bulb can easily draw more than 200 mA during conduction. This value largely exceeds the holding current of typical dimmers. Therefore, there is usually no problem in dimming an incandescent bulb. LED lighting generally draws less current, typically ranging from 10 to 150 mA depending on the circuit design. At smaller current levels, once the dimmer conducts, the load current may not satisfy the hold current requirement of the TRIAC in the dimmer, and the dimmer may enter a retriggering state that causes flickering of the LED light.

SUMMARY

According to some embodiments of the inventive subject matter, a lighting apparatus comprises an input power terminal, a light source element coupled to the input power terminal, and a current bleeder module that is connected to the input power terminal and is configured to draw a current from the input power terminal responsive to a phase cut input power signal received at the input power terminal during a first portion of a period of the phase cut input power signal and is configured as an open circuit so as not to draw current from the input power terminal during a second portion of the period of the phase cut input power signal.

In other embodiments, the lighting apparatus further comprises a dimmer module that is connected to the input power terminal and is configured to generate the phase cut input power signal responsive to a power signal.

In still other embodiments, the dimmer module comprises a TRIAC device and a sum of the current drawn by the current bleeder module and a current drawn by the light source is not less than a hold current associated with the TRIAC device.

In still other embodiments, the current bleeder module comprises a detector circuit, an enable circuit connected to the detector circuit, and a current sink circuit connected to the enable circuit.

In still other embodiments, the detector circuit is configured to detect a change in voltage per unit of time of the phase cut input power signal.

In still other embodiments, the detector circuit comprises a high pass filter that is configured to generate a first output signal responsive to the phase cut input power signal and a storage circuit that is configured to store an input voltage responsive to the first output signal, the input voltage being indicative of a magnitude of the change in voltage per unit of time of the phase cut input power signal.

In still other embodiments, the detector circuit further comprises a first comparator that is configured to generate a second output signal responsive to the input voltage and a reference voltage.

In still other embodiments, the first comparator is configured to generate the second output signal at a first value when the comparison responsive to the input voltage and the reference voltage indicates the magnitude of the change in voltage per unit of time of the phase cut input power signal exceeds a threshold and at a second value when the comparison responsive to the input voltage and the reference voltage indicates the magnitude of the change in voltage per unit of time of the phase cut input power signal fails to exceed the threshold.

In still other embodiments, the storage circuit comprises a capacitor and a resistor and a time that the second output signal has the first value is based on values of the capacitor and the resistor.

In still other embodiments, the enable circuit comprises a second comparator that is configured to generate a third output signal responsive to the second output signal from the first comparator and the phase cut input power signal.

In still other embodiments, the second comparator is configured to generate the third output signal at a first value when the comparison responsive to the second output signal from the first comparator and the phase cut input power signal indicates that the phase cut input power signal has fallen below a threshold and at a second value when the comparison responsive to the second output signal from the first comparator and the phase cut input power signal indicates that the phase cut input power signal has not fallen below the threshold.

In still other embodiments, the current sink circuit comprises a switch that is responsive to the third output signal.

In still other embodiments, the lighting apparatus further comprises a rectifier module connected to the input power terminal and configured to generate a constant polarity phase cut input power signal.

In still other embodiments, the phase cut input power signal is a leading edge phase cut input power signal.

In still other embodiments, the light source element comprises a Light Emitting Diode (LED).

In still other embodiments, the light source element comprises a string of Light Emitting Diode (LED) sets coupled in series, each set comprising at least one LED.

In further embodiments of the inventive subject matter a method comprises generating a phase cut input power signal responsive to a power signal and drawing a current from an input power terminal responsive to the phase cut input power signal during a first portion of a period of the phase cut input power signal and not drawing current from the input power terminal during a second portion of the period of the phase cut input power signal.

In still further embodiments, generating the phase cut input power signal comprises using a dimmer module that is connected to the input power terminal to generate the phase cut input power signal responsive to the power signal.

In still further embodiments, a sum of the current drawn during the first portion of the period of the phase cut input power signal and a current drawn by a light source element is not less than a hold current associated with a TRIAC device in the dimmer module.

In still further embodiments, the method further comprises detecting a change in voltage per unit of time of the phase cut input power signal.

In still further embodiments, the method further comprises high pass filtering the phase cut input power signal to generate a first output signal and storing an input voltage responsive to the first output signal, the input voltage being indicative of a magnitude of the change in voltage per unit of time of the phase cut input power signal.

In still further embodiments, the method further comprises generating a second output signal responsive to the input voltage and a reference voltage.

In still further embodiments, generating the second output signal comprises generating the second output signal at a first value when a comparison responsive to the input voltage and the reference voltage indicates the magnitude of the change in voltage per unit of time of the phase cut input power signal exceeds a threshold and generating the second output signal at a second value when the comparison responsive to the input voltage and the reference voltage indicates the magnitude of the change in voltage per unit of time of the phase cut input power signal fails to exceed the threshold.

In still further embodiments, the method further comprises generating a third output signal responsive to the second output signal from and the phase cut input power signal.

In still further embodiments, generating the third output signal comprises generating the third output signal at a first value when a comparison responsive to the second output signal and the phase cut input power signal indicates that the phase cut input power signal has fallen below a threshold and generating the third output signal at a second value when the comparison responsive to the second output signal and the phase cut input power signal indicates that the phase cut input power signal has not fallen below the threshold.

In still further embodiments, the method further comprises operating a transistor responsive to the third output signal to draw current from the input power terminal during the first portion of the period of the phase cut input power signal and to not draw current from the input power terminal during the second portion of the period of the phase cut input power signal.

In still further embodiments, the method further comprises generating a constant polarity phase cut input power signal.

In still further embodiments, the phase cut input power signal is a leading edge phase cut input power signal.

In still further embodiments, the light source element comprises a Light Emitting Diode (LED).

In still further embodiments, the light source element comprises a string of Light Emitting Diode (LED) sets coupled in series, each set comprising at least one LED.

BRIEF DESCRIPTION OF THE DRAWINGS

The accompanying drawings, which are included to provide a further understanding of the inventive subject matter and are incorporated in and constitute a part of this application, illustrate certain embodiment(s) of the inventive subject matter. In the drawings.

DETAILED DESCRIPTION

Figure 1A:
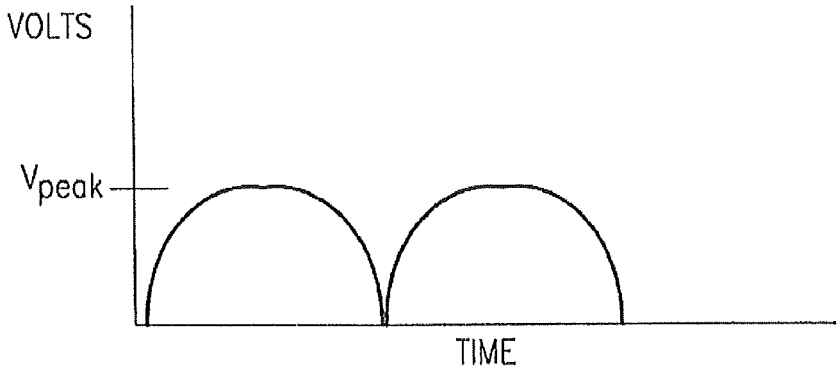
FIG.1A Prior Art
FIGS. 1A-1C are waveform diagrams of a cycle of a full wave rectified AC line signal with and without phase cut dimming.
Figure 1B:
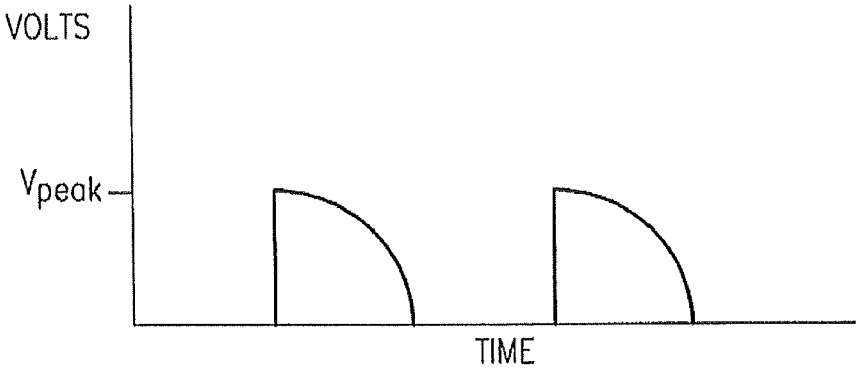
FIG.1B Prior Art
Figure 1C:
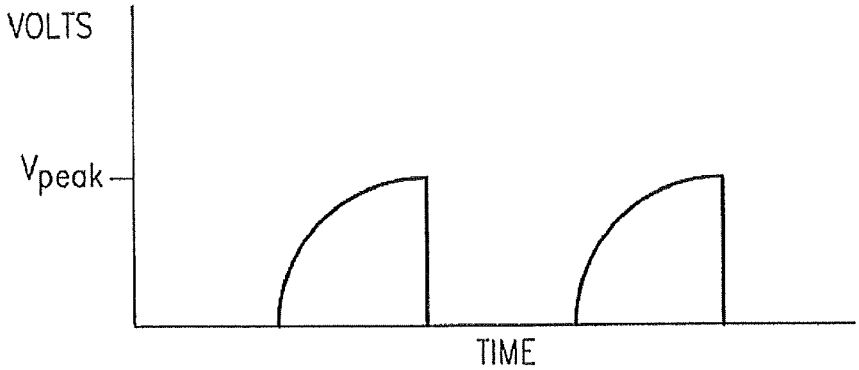
FIG.1C Prior Art

Embodiments of the present inventive subject matter now will be described more fully hereinafter with reference to the accompanying drawings, in which embodiments of the inventive subject matter are shown. This inventive subject matter may, however, be embodied in many different forms and should not be construed as limited to the embodiments set forth herein. Rather, these embodiments are provided so that this disclosure will be thorough and complete, and will fully convey the scope of the inventive subject matter to those skilled in the art. Like numbers refer to like elements throughout the description. Each embodiment described herein also includes its complementary conductivity embodiment.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be understood that when an element or layer is referred to as being "on" another element or layer, the element or layer can be directly on another element or layer or intervening elements or layers may also be present. In contrast, when an element is referred to as being "directly on" another element or layer, there are no intervening elements or layers present. As used herein, the term "and/or" includes any and all combinations of one or more of the associated listed items.

Spatially relative terms, such as "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. Throughout the specification, like reference numerals in the drawings denote like elements.

Embodiments of the inventive subject matter are described herein with reference to plan and perspective illustrations that are schematic illustrations of idealized embodiments of the inventive subject matter. As such, variations from the shapes of the illustrations as a result, for example, of manufacturing techniques and/or tolerances, are to be expected. Thus, the inventive subject matter should not be construed as limited to the particular shapes of objects illustrated herein, but should include deviations in shapes that result, for example, from manufacturing. Thus, the objects illustrated in the figures are schematic in nature and their shapes are not intended to illustrate the actual shape of a region of a device and are not intended to limit the scope of the inventive subject matter.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item.

The expression "lighting apparatus," as used herein, is not limited, except that it indicates that the device is capable of emitting light. That is, a lighting apparatus can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing ac incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting, work lights, etc., mirrors/vanity lighting, or any other light emitting device.

The present inventive subject matter further relates to an illuminated enclosure (the volume of which can be illuminated uniformly or non-uniformly), comprising an enclosed space and at least one lighting apparatus according to the present inventive subject matter, wherein the lighting apparatus illuminates at least a portion of the enclosed space (uniformly or non-uniformly).

Some embodiments of the present invention stem from a realization that leading edge, phase cut dimmer circuits may use a TRIAC device that does remain in the on state after triggering without a current larger than the hold current passing through the main terminals and that some TRIACs may have difficulty remaining on when a low current is drawn through the main terminals, such as in the case of some light source elements, e.g., LED lighting elements. According to some embodiments of the present invention, a current bleeder circuit is configured to detect when the dimmer is in operation and generating a leading edge, phase cut signal. The current bleeder comprises an enable circuit portion that, responsive to detecting the leading edge, phase cut signal, compares a replica of the leading edge, phase cut signal with a reference voltage level such that when the voltage level of the replica of the leading edge, phase cut signal drops below the reference voltage level the enable circuit generates an output signal to activate a current sink portion of the current bleeder circuit to sink current, which, at least when combined with a current drawn by the light source element, will satisfy the hold current requirements of the TRIAC device in the dimmer circuit when the current drawn by the light source element is low.

Figure 2:
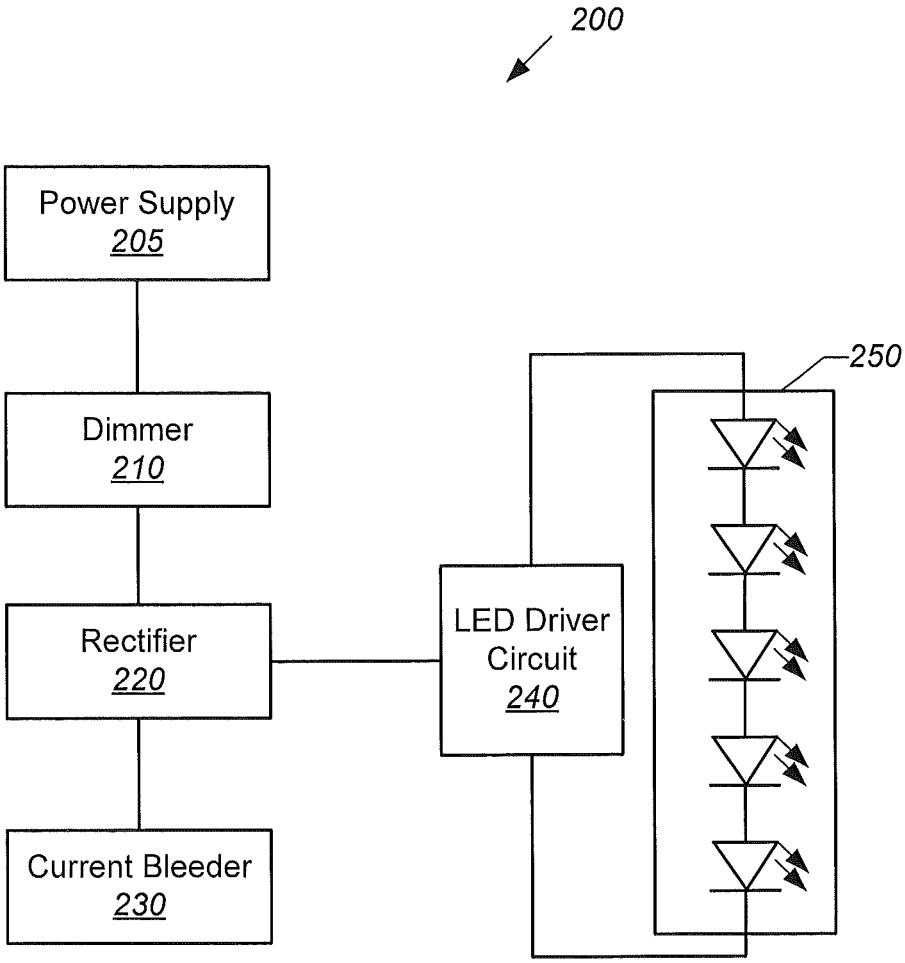
FIG. 2 is a block diagram of a lighting apparatus according to some embodiments of the inventive subject matter.

FIG. 2 illustrates a lighting apparatus 200 according to some embodiments of the inventive subject matter. The apparatus 200 comprises a power supply 205, a dimmer 210, a rectifier 220, a current bleeder 230, an LED driver circuit 240, and an LED string 250 that are connected as shown. The power supply 205 may be an AC voltage source as is common found in a household application. The dimmer 210 may be a leading edge phase control dimmer that includes a TRIAC device as described above. The dimmer 210 brightens and dims the light output from the LED string by adjusting the RMS voltage that is applied to the LED string 250. The rectifier 220 provides an output signal having one polarity in response to the dual-polarity AC input signal from the power supply 205 via the dimmer 210. The current bleeder 230 may be configured to detect when the dimmer 210 uses leading edge phase control dimming and to draw a hold current from the TRIAC in the dimmer 210 when the load current of the LED string 250 is insufficient to satisfy the hold current requirement of the TRIAC. The driver LED driver circuit 240 may be any suitable driver circuit capable of responding to a pulse width modulated input that reflects the level of dimming of the LED string 250. The particular configuration of the LED driver circuit 240 will depend on the application of the lighting device 200. For example, the driver circuit may be a boost or buck power supply. Likewise, the LED driver circuit 240 may be a constant current or constant voltage pulse width modulated power supply. For example, the LED driver circuit may be as described in U.S. Pat. No. 7,071,762 the disclosure of which is hereby incorporated herein by reference. Alternatively, the LED driver circuit 240 may be a driver circuit using linear regulation, such as described in U.S. Pat. No. 7,038,399 and U.S. Patent Publication No. 2008/0088248, the disclosures of which are incorporated herein by reference. The particular configuration of the LED driver circuit 240 will depend on the application of the lighting device 200. The LED string 250 comprises a string of one or more serially connected LED sets. Each of the LED sets includes at least one LED. For example, individual ones of the sets may comprise a single LED and/or individual sets may include multiple LEDs connected in various parallel and/or serial arrangements.

Figure 3:
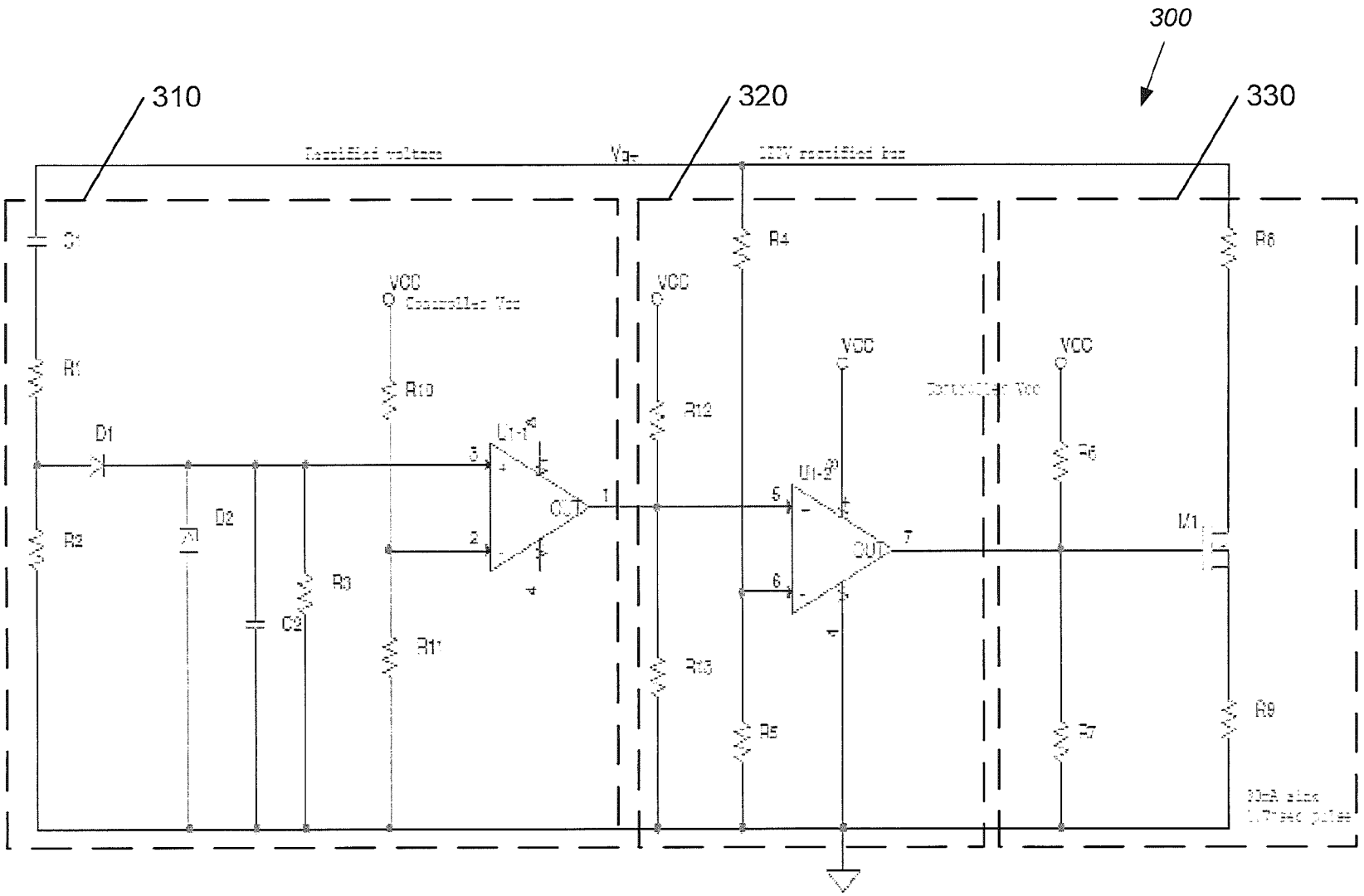
FIG. 3 is a schematic of the current bleeder of FIG. 2 according to some embodiments of the inventive subject matter.

FIG. 3 is a schematic of a current bleeder circuit 300 that can be used to implement the current bleeder 230 of FIG. 2 according to some embodiments of the inventive subject matter. The current bleeder circuit 300 comprises a detector circuit 310, an enable circuit 320, and a current sink circuit 330. The detector circuit 310 comprises capacitors C1 and C2, resistors R1, R2, R3, R10, and R11, diodes D1 and D2, and comparator U1-1, which are connected as shown. The enable circuit 320 comprises resistors R12, R13, R4, R5, and comparator U1-2, which are connected as shown. The current sink circuit 330 comprises resistors R6, R7, R8, R9, and MOSFET M1, which are connected as shown.

A TRIAC based, leading edge dimmer 210 cuts the input AC waveform by a phase angle depending on the dimmer setting. The rectifier 220 rectifies this phase cut waveform and presents the rectified, phase cut waveform to the LED driver circuit 240. The waveform to be presented to the LED driver circuit 240 will have a sharp dV/dt characteristic. The detector circuit 310 of the current bleeder circuit 300 detects this sharp dV/dt characteristic. Specifically, the capacitor C1 acts as a low impedance element to the high frequency dV/dt signal at the leading edge of the phase cut signal, i.e., acts as a high pass filter. This results in a voltage being applied across resistor R2, which charges the capacitor C2 to a voltage that is clamped by the Zener diode D2. When there is no dimmer present or the dimmer uses a technology different than a TRIAC based leading edge dimming technology, there is no sharp dV/dt and capacitor C1 acts as a high impedance element. As a result, little or no voltage is created on the resistor R2. Thus, the detection circuit 310 is used to detect the presence of a TRIAC based, leading edge dimmer. When the voltage on input terminal 3 of the comparator U1-1 is greater than the reference voltage on the reference input terminal 2, which is determined by the values of resistors R10 and R11 the output terminal 1 of the comparator U1-1 is driven high.

The enable circuit 320 is responsive to the voltage on output terminal 1 of the comparator U1-1 from the detector circuit 310. When the output voltage on output terminal 1 of the comparator U1-1 is driven to a high level based on the values of resistors R12 and R13, the voltage on the input terminal 5 of the comparator U1-2 is compared with a replica of the rectified, phase cut waveform on the input terminal 6 of the comparator U1-2. When the voltage level on input terminal 6 of the comparator U1-2 falls below the level of the voltage level on input terminal 5 of the comparator U1-2, the output terminal 7 of the comparator U1-2 is driven to a high level. A replica of the rectified, phase cut waveform is used in the comparison by stepping down the voltage of the rectified, phase cut waveform using a voltage divider. In accordance with various embodiments of the present invention, the voltage levels of the rectified, phase cut waveform and the output voltage from the comparator U1-1 can be amplified and/or attenuated to affect the comparison result so that the current sink circuit 330 is activated at desired times.

The signal output from the output terminal 7 of the comparator U1-2 is used to drive the MOSFET M1 of the current sink circuit 330, which effectively operates as a switch. The biasing resistors R6 and R7 are set to maintain the voltage on the gate terminal of the MOSFET M1 at a level such that the MOSFET M1 does not turn on unless the signal output from the output terminal 7 of the comparator U1-2 is driven high. When the signal output from the output terminal 7 of the comparator U1-2 is driven high, the MOSFET M1 is turned on and current flows through the resistors R8, R9, and M1 to provide a current sink to draw a hold current from the TRIAC in the dimmer 210 when the load current of the LED string 250 is insufficient to satisfy the hold current requirement of the TRIAC. The amount of current flowing through the MOSFET M1 when it is turned on can be adjusted by the value of the resistor R9. The higher the value of the resistor R9, the lower the current flow. The current through the resistor R9 can be expressed as follows:

$$I_{R9}=(V_g-V_{gsth})/R9$$

Where $V_g$ is the voltage applied to the gate terminal of the MOSFET M1 based on the values of R6 and R7 and $V_{gsth}$ is the gate-source threshold voltage of the MOSFET M1.

The duration of time that the MOSFET M1 is turned on to provide a current sink can be adjusted by adjusting the time in which the signal output from the comparator U1-1 is driven high. Specifically, the values of the capacitor C2 and the resistor R3, which is used to discharge the capacitor C2, can be adjusted as these values form the basis for the time constant for the discharge process. The point at which the MOSFET M1 is turned on can be adjusted various ways in accordance with different embodiments of the inventive subject matter. In some embodiments, the value of the resistor R5 can be adjusted in which case the greater the value of the resistor R5, the lower the voltage is of the rectified, phase cut waveform at which the MOSFET M1 is turned on and vice versa. In other embodiments, the value of the resistor R13 can be adjusted in which case the greater the value of the resistor R13, the higher the voltage is of the rectified, phase cut waveform at which the MOSFET M1 is turned on and vice versa.

Figure 4:
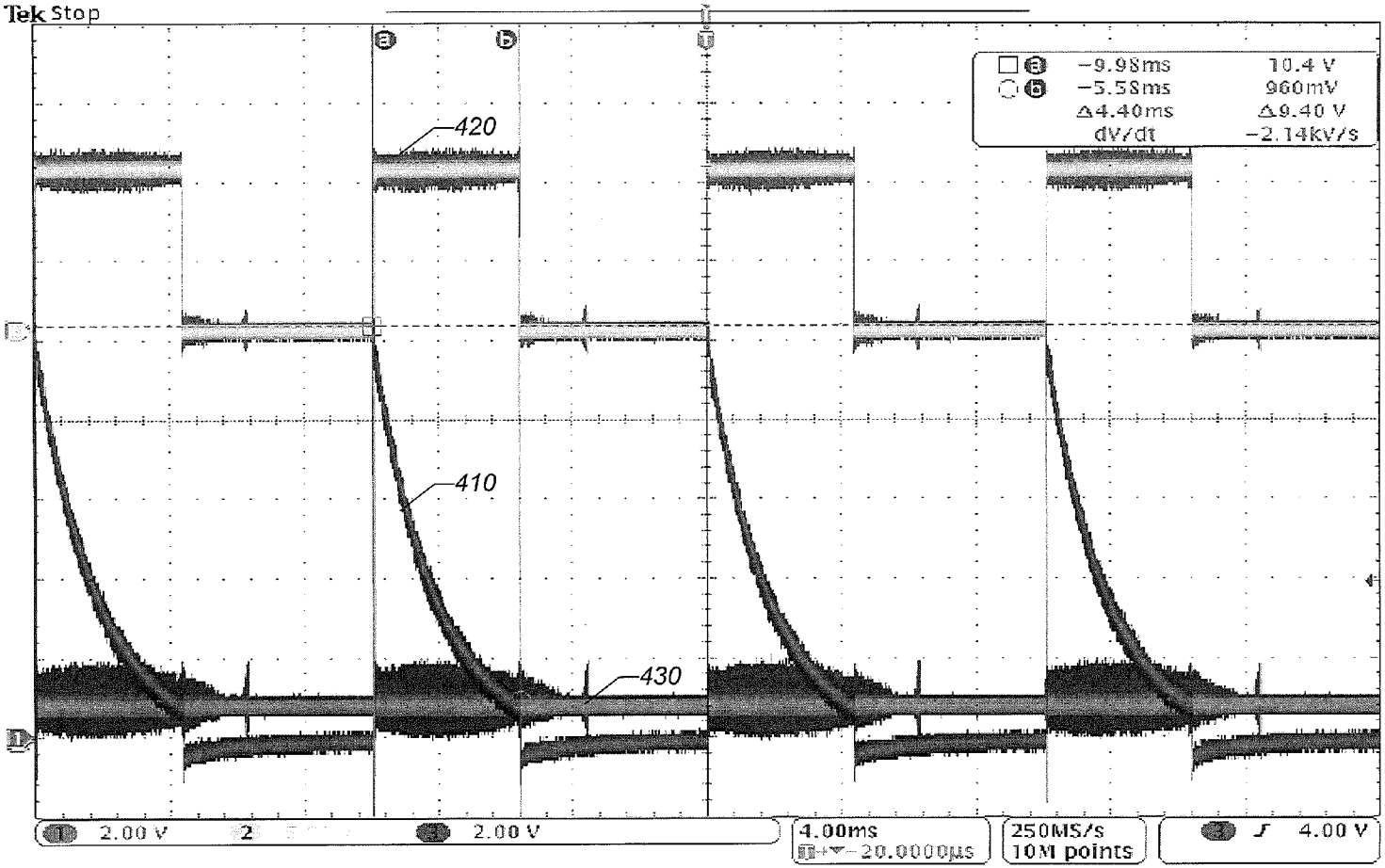
FIGS. 4-6 are waveform diagrams that illustrate operations of the current bleeder of FIG. 3 according to some embodiments of the inventive subject matter.

FIG. 4 is a waveform diagram that illustrates operations of the current bleeder circuit 300 of FIG. 3 according to some embodiments of the inventive subject matter. Waveform 410 illustrates the voltage across capacitor C2 as it discharges through resistor R3 upon detection of the sharp dV/dt characteristic of the rectified, phase cut waveform. Waveform 420 illustrates the pulse created at the output terminal 1 of the comparator U1-1 to turn on the MOSFET M1 and waveform 430 illustrates the reference voltage applied to input terminal 2 of the comparator U1-1 based on the values of resistors R10 and R11.

Figure 5:
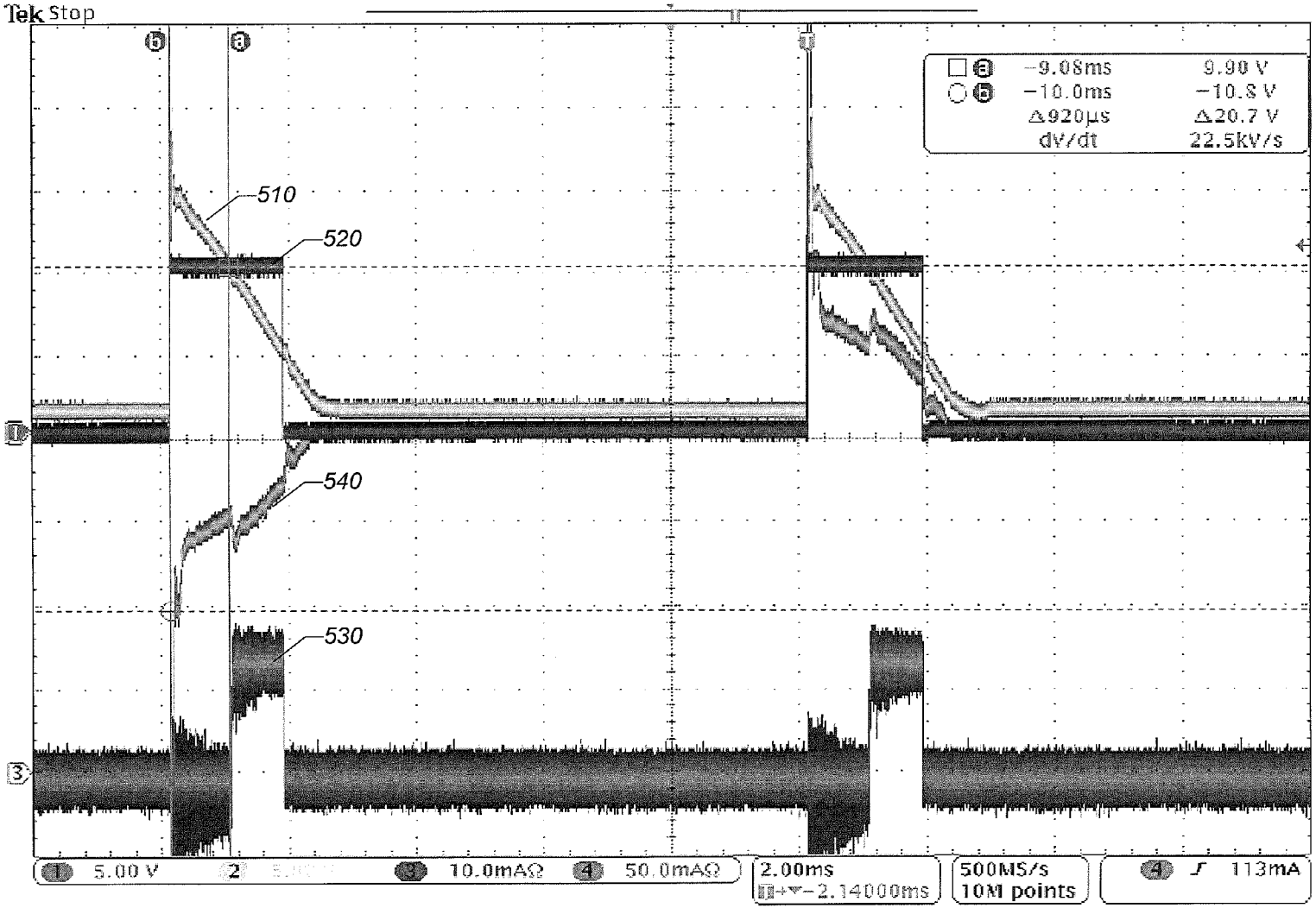

FIG. 5 is a waveform diagram that further illustrates operations of the current bleeder circuit 300 of FIG. 3 according to some embodiments of the inventive subject matter. Waveform 510 illustrates the rectified, phase cut waveform applied to the input terminal 6 of the comparator U1-2 and waveform 520 illustrates the signal output from the comparator U1-1 and applied to the input terminal 5 of the comparator U1-2. As can be seen in FIG. 5, when the voltage level of the rectified, phase cut waveform falls below voltage level of the signal applied to the input terminal 5 of the comparator U1-2, the output terminal 7 of the comparator U1-2 is driven high to turn on the MOSFET M1 to allow current to flow through the MOSFET M1 as illustrated by waveform 530. Waveform 540 corresponds to the AC current.

Figure 6:
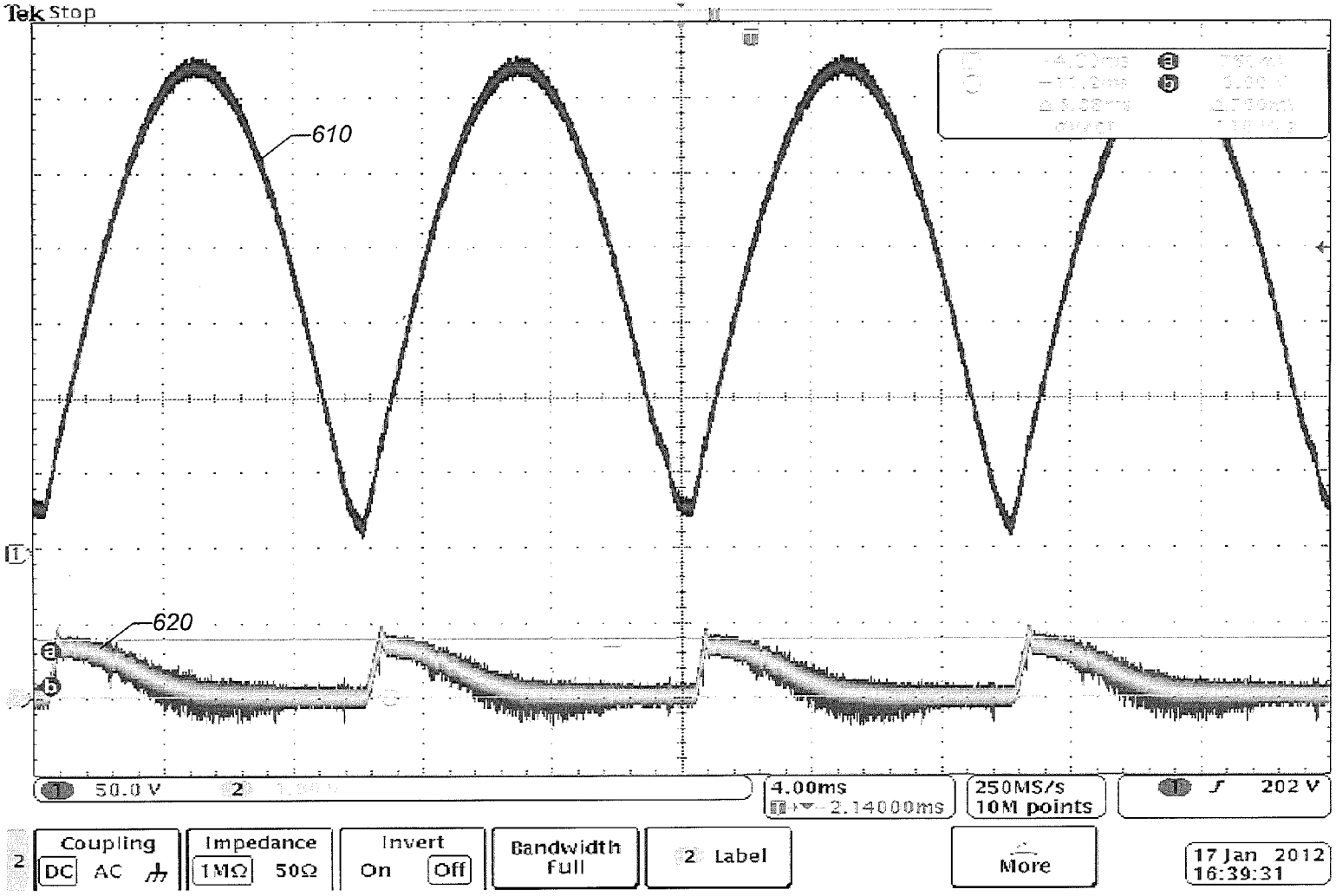

FIG. 6 is a waveform diagram that further illustrates operations of the current bleeder circuit 300 of FIG. 3 according to some embodiments of the inventive subject matter. FIG. 6 illustrates an example in which the dimmer 210 of FIG. 2 is removed or otherwise deactivated to remove any leading edge phase cut dimming from the rectified AC signal. As shown in FIG. 6, the rectified AC signal represented by waveform 610 does not possess a sharp enough dV/dt to charge the capacitor C2 as shown by waveform 620. As a result, the comparator U1-1 never drives the signal high at its output terminal 1 to trigger activation of the current sink portion of the current bleeder circuit 300 when the voltage level of the rectified, phase cut waveform falls below the reference voltage at the input terminal 5 of the comparator U1-2. In this way, the current bleeder circuit 300 avoids operations and sinking current unnecessarily when a lighting apparatus fails to include a leading edge, phase cut dimmer using a TRIAC or when the leading edge, phase cut dimmer is operating with reduced dimming such that the dV/dt of the leading edge of the phase cut signal is less than a threshold. In this case, the current drawn by the LED string 250 is generally sufficient to satisfy the hold current requirement of the TRIAC.

Lighting apparatus circuits as described herein may be implemented in a number of different ways in accordance with various embodiments of the inventive subject matter. For example, rectifier circuitry, current bleeder circuitry, LED driver circuitry, and/or LEDs as illustrated, for example, in the embodiments of FIGS. 2-6, may be integrated in a common unit configured to be coupled to an AC power source. Such an integrated unit may take the form, for example, of a lighting fixture, a screw-in or plug in replacement for a conventional incandescent or compact fluorescent lamp, an integrated circuit or module configured to be used in a lighting fixture or lamp or a variety of other form factors. In some embodiments, portions of the current bleeder circuitry may be integrated with the LEDs using composite semiconductor structures.

Figure 7:
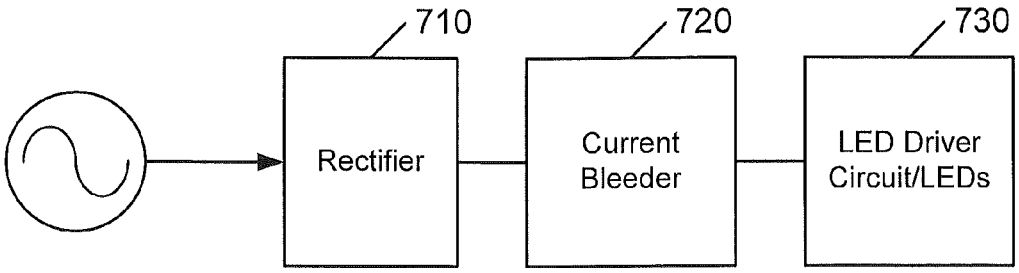
FIGS. 7-10 illustrate various arrangements of lighting apparatus components according to some embodiments of the inventive subject matter.
Figure 8:
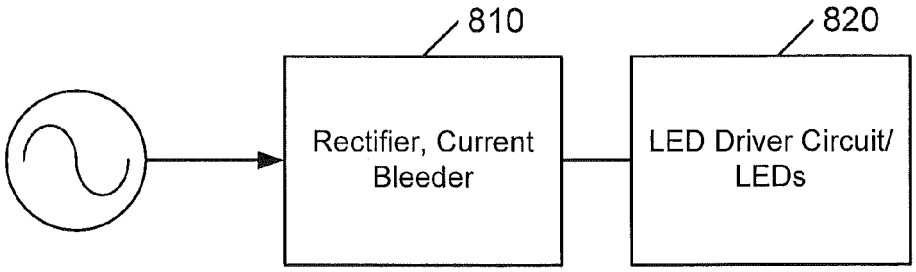
Figure 9:
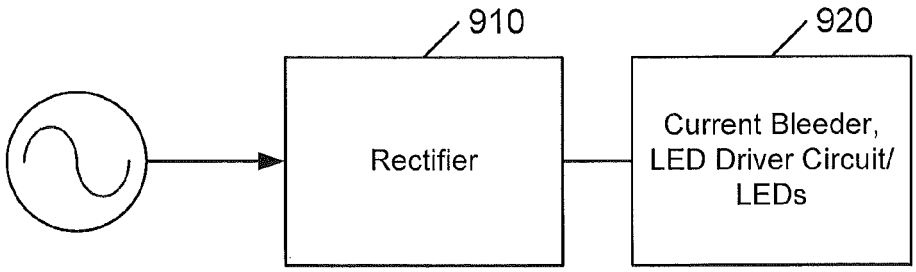
Figure 10:
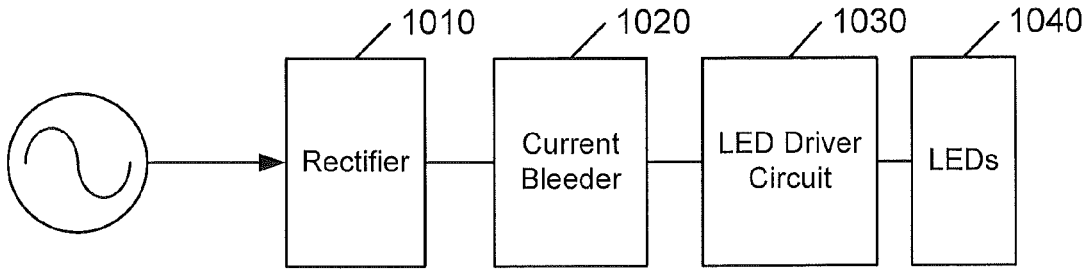

In some embodiments, such as shown in FIG. 7, a rectifier circuit, current bleeder circuit, and LED driver circuit/LEDs may be implemented as separate units 710, 720, 730 configured to be connected to an AC power source and interconnected, for example, by wiring, connectors and/or printed circuit conductors. In further embodiments, as shown in FIG. 8, a rectifier circuit and current bleeder circuit may be integrated in a common unit 810, e.g., in a common microelectronic substrate, thick film assembly, circuit card, module or the like, configured to be connected to an AC power source and to an LED driver circuit/LEDs 820. As shown in FIG. 9, a current bleeder circuit and an LED driver circuit/LEDs may be similarly integrated in a common unit 920 that is configured to be coupled to a rectifier circuit 910. In still other embodiments, a rectifier circuit, current bleeder circuit, LED driver circuit, and LEDs may be implemented as separate units 1010, 1020, 1030, and 1040 as shown in FIG. 10.

In the drawings and specification, there have been disclosed typical embodiments of the inventive subject matter and, although specific terms are employed, they are used in a generic and descriptive sense only and not for purposes of limitation, the scope of the inventive subject matter being set forth in the following claims.

That which is claimed:

1. A lighting apparatus, comprising:

an input power terminal;

a light source element coupled to the input power terminal; and a current bleeder module that is connected to the input power terminal and comprises a detector circuit that is configured to detect a change in voltage per unit of time of a phase cut input power signal received at the input power terminal, the current bleeder module being configured, responsive to the change in voltage per unit of time of the phase cut input power signal, to draw a current from the input power terminal during a first portion of a period of the phase cut input power signal and being configured as an open circuit so as not to draw current from the input power terminal during a second portion of the period of the phase cut input power signal.

2. The lighting apparatus of claim 1, further comprising:

a dimmer module that is connected to the input power terminal and is configured to generate the phase cut input power signal responsive to a power signal.

3. The lighting apparatus of claim 2, wherein the dimmer module comprises a TRIAC device and wherein a sum of the current drawn by the current bleeder module and a current drawn by the light source is not less than a hold current associated with the TRIAC device.

4. The lighting apparatus of claim 1, wherein the current bleeder module further comprises:

an enable circuit connected to the detector circuit; and a current sink circuit connected to the enable circuit.

5. The lighting apparatus of claim 1, wherein the detector circuit comprises:

a high pass filter that is configured to generate a first output signal responsive to the phase cut input power signal; and a storage circuit that is configured to store an input voltage responsive to the first output signal, the input voltage being indicative of a magnitude of the change in voltage per unit of time of the phase cut input power signal.

6. The lighting apparatus of claim 5, wherein the detector circuit further comprises a first comparator that is configured to generate a second output signal responsive to the input voltage and a reference voltage.

7. The lighting apparatus of claim 6, wherein the first comparator is configured to generate the second output signal at a first value when the comparison responsive to the input voltage and the reference voltage indicates the magnitude of the change in voltage per unit of time of the phase cut input power signal exceeds a threshold and at a second value when the comparison responsive to the input voltage and the reference voltage indicates the magnitude of the change in voltage per unit of time of the phase cut input power signal fails to exceed the threshold.

8. The lighting apparatus of claim 7, wherein the storage circuit comprises a capacitor and a resistor and wherein a time that the second output signal has the first value is based on values of the capacitor and the resistor.

9. The lighting apparatus of claim 6, wherein the enable circuit comprises a second comparator that is configured to generate a third output signal responsive to the second output signal from the first comparator and the phase cut input power signal.

10. The lighting apparatus of claim 9, wherein the second comparator is configured to generate the third output signal at a first value when the comparison responsive to the second output signal from the first comparator and the phase cut input power signal indicates that the phase cut input power signal has fallen below a threshold and at a second value when the comparison responsive to the second output signal from the first comparator and the phase cut input power signal indicates that the phase cut input power signal has not fallen below the threshold.

11. The lighting apparatus of claim 9, wherein the current sink circuit comprises a switch that is responsive to the third output signal.

12. The lighting apparatus of claim 1, further comprising:

a rectifier module connected to the input power terminal and configured to generate a constant polarity phase cut input power signal.

13. The lighting apparatus of claim 1, wherein the phase cut input power signal is a leading edge phase cut input power signal.

14. The lighting apparatus of claim 1, wherein the light source element comprises a Light Emitting Diode (LED).

15. The method of claim 1, wherein the light source element comprises a string of Light Emitting Diode (LED) sets coupled in series, each set comprising at least one LED.

16. A method, comprising:

generating a phase cut input power signal responsive to a power signal; and detecting a change in voltage per unit of time of a phase cut input power signal; and drawing a current from an input power terminal during a first portion of a period of the phase cut input power signal and not drawing current from the input power terminal during a second portion of the period of the phase cut input power signal, responsive to the change in voltage per unit of time of the phase cut input power signal.

17. The method of claim 16, wherein generating the phase cut input power signal comprises using a dimmer module that is connected to the input power terminal to generate the phase cut input power signal responsive to the power signal.

18. The method of claim 17, wherein a sum of the current drawn during the first portion of the period of the phase cut input power signal and a current drawn by a light source element is not less than a hold current associated with a TRIAC device in the dimmer module.

19. The method of claim 16, further comprising:

high pass filtering the phase cut input power signal to generate a first output signal; and storing an input voltage responsive to the first output signal, the input voltage being indicative of a magnitude of the change in voltage per unit of time of the phase cut input power signal.

20. The method of claim 19, further comprising:

generating a second output signal responsive to the input voltage and a reference voltage.

21. The method of claim 20, wherein generating the second output signal comprises:

generating the second output signal at a first value when a comparison responsive to the input voltage and the reference voltage indicates the magnitude of the change in voltage per unit of time of the phase cut input power signal exceeds a threshold; and generating the second output signal at a second value when the comparison responsive to the input voltage and the reference voltage indicates the magnitude of the change in voltage per unit of time of the phase cut input power signal fails to exceed the threshold.

22. The method of claim 20, further comprising:

generating a third output signal responsive to the second output signal from and the phase cut input power signal.

23. The method of claim 22, wherein generating the third output signal comprises:

generating the third output signal at a first value when a comparison responsive to the second output signal and the phase cut input power signal indicates that the phase cut input power signal has fallen below a threshold; and generating the third output signal at a second value when the comparison responsive to the second output signal and the phase cut input power signal indicates that the phase cut input power signal has not fallen below the threshold.

24. The method of claim 22, further comprising:

operating a transistor responsive to the third output signal to draw current from the input power terminal during the first portion of the period of the phase cut input power signal and to not draw current from the input power terminal during the second portion of the period of the phase cut input power signal.

25. A method, comprising:

generating a constant polarity phase cut input power signal responsive to a power signal; and drawing a current from an input power terminal during a first portion of a period of the constant polarity phase cut input power signal and not drawing current from the input power terminal during a second portion of the period of the constant polarity phase cut input power signal.

26. A method, comprising:

generating a leading edge phase cut input power signal responsive to a power signal; and drawing a current from an input power terminal during a first portion of a period of the leading edge phase cut input power signal and not drawing current from the input power terminal during a second portion of the period of the leading edge phase cut input power signal.

27. The method of claim 16, wherein the light source element comprises a Light Emitting Diode (LED).

28. The method of claim 16, wherein the light source element comprises a string of Light Emitting Diode (LED) sets coupled in series, each set comprising at least one LED.

* * * * *